US009598204B1

(12) United States Patent
Schneider

(10) Patent No.: US 9,598,204 B1
(45) Date of Patent: Mar. 21, 2017

(54) LID WITH BREAKAWAY SKIM PLATE FOR CONTAINER FOR LOADING BULK MATERIAL THEREFROM

(71) Applicant: Albion Engineering Company, Moorestown, NJ (US)

(72) Inventor: Mark C. Schneider, Morrestown, NJ (US)

(73) Assignee: Albion Engineering Company, Moorestown, NJ (US)

( * ) Notice: Subject to any disclaimer, the term of this patent is extended or adjusted under 35 U.S.C. 154(b) by 0 days.

(21) Appl. No.: 15/001,793

(22) Filed: Jan. 20, 2016

(51) Int. Cl.
*B65D 17/28* (2006.01)
*B65D 17/00* (2006.01)

(52) U.S. Cl.
CPC ..... *B65D 17/161* (2013.01); *B65D 17/20* (2013.01); *B65D 2517/0007* (2013.01)

(58) Field of Classification Search
CPC ..... B65D 17/161; B65D 17/20; B65D 2517/0007
USPC ..... 141/1, 27, 65; 220/258.3–258.5, 265, 220/266, 276
See application file for complete search history.

(56) References Cited

U.S. PATENT DOCUMENTS 2,393,217 A 1/1946 Brewton
2,601,169 A 6/1952 Purvis
3,171,449 A * 3/1965 Ellms ..... B65G 69/181 141/330
4,209,105 A 6/1980 Dominique
4,723,674 A * 2/1988 Nunes ..... B65D 39/02 215/231
4,942,977 A * 7/1990 Hidding ..... B65D 83/40 220/270
4,971,218 A * 11/1990 Buchner ..... B65D 17/163 215/260
5,117,998 A 6/1992 Handzel
5,469,897 A 11/1995 Haytner et al.
6,779,676 B2 * 8/2004 Ciccone ..... B65D 43/0256 215/254
6,786,447 B2 * 9/2004 Geib ..... A47K 10/3818 215/235
8,800,612 B2 * 8/2014 Saito ..... B65B 39/007 141/352
2004/0000573 A1 * 1/2004 Geib ..... A47K 10/3818 225/1
2011/0036454 A1 * 2/2011 Saito ..... B65B 39/007 141/331

* cited by examiner

*Primary Examiner* — Nicolas A Arnett
(74) *Attorney, Agent, or Firm* — Caesar Rivise, PC

(57) ABSTRACT

A lid for a container for bulk material includes a flange for sealing the lid to the container, the flange having an internal peripheral edge. The lid further includes a skim plate having an outer peripheral edge and an aperture sized to receive a barrel of a device for dispensing bulk material. A first tear strip is disposed between the outer peripheral edge of the skim plate and the internal peripheral edge of the flange to release the skim plate from the flange. A small disk portion is disposed in the aperture of the skim plate. A second tear strip is disposed between the outer peripheral edge of the small disk portion and the aperture to release the small disk portion from the skim plate. The flange, skim plate, small disk portion, the first annular tear strip and the second annular tear strip all comprise a unitary molded article.

5 Claims, 4 Drawing Sheets

LID WITH BREAKAWAY SKIM PLATE FOR CONTAINER FOR LOADING BULK MATERIAL THEREFROM

BACKGROUND OF THE INVENTION

This invention relates generally to containers for bulk material. In particular, the invention relates to a lid for such a container.

The present invention is directed to a container containing bulk material (typically highly viscous materials, but also substantially free flowing materials) that is used in conjunction with a dispensing gun for loading into to the barrel of the gun such bulk material. For example, guns which could be loaded with a caulking compound in situ from a bulk container have been developed to avoid the waste and expense associated with prefilled collapsible "sausage" or "chub" packages or other known viscous material packaging such as cartridges.

Loading bulk material into the barrel of a device or gun for dispensing such materials has typically been accomplished where the bulk material is purchased in containers, such as the ubiquitous five gallon container. The barrel of the gun defines a cylindrical chamber into which the bulk material is drawn from the container prior to dispensing. The barrel is inserted, open end down, into the bulk material and, by retracting a piston within the barrel of the dispensing device, the bulk material is drawn from the container into the barrel for dispensing.

There are a number of problems associated with the filling of bulk material from such a container. In particular, the bulk material can be costly. Exposure to air in many circumstances, allows the bulk material to quickly harden or cure. Since the bulk material may be costly and difficult to manage once hardening commences, it would be highly desirable to reduce the quantity of bulk material exposed to air to reduce the speed of such hardening or curing.

BRIEF SUMMARY OF THE INVENTION

In an exemplary embodiment of the present invention, a lid for use with a container for bulk material is provided. The lid includes an annular flange for sealing the lid to the container. The flange has an internal peripheral edge. A skim plate is provided having an outer peripheral edge and an aperture sized to receive a barrel of a device for dispensing bulk material. The aperture has an annular edge. A first annular tear strip is disposed between the outer peripheral edge of the skim plate and the internal peripheral edge of the annular flange to release the skim plate from the annular flange. A small disk portion having an outer peripheral edge is disposed in the aperture of the skim plate. A second annular tear strip is disposed between the outer peripheral edge of the small disk portion and the annular edge of the aperture of the skim plate to release the small disk portion from the skim plate. The flange, skim plate, small disk portion, the first annular tear strip and the second annular tear strip, all comprise a unitary molded article. Withdrawing of the bulk material from the container into the barrel of the device for dispensing bulk material is facilitated through the aperture such that the skim plate rests on top of the bulk material remaining in the container to minimize curing or drying of the bulk material. The small disk portion may or may not be coaxial with the skim plate.

Another exemplary embodiment of the present invention includes a lid and container assembly for bulk material for loading the bulk material from the container into the barrel of a device for dispensing bulk material. The lid is as described above. The lid is sealingly attached to the container.

A method for loading bulk material from a container into the barrel of a device for dispensing the bulk material is also provided. The method includes the steps of providing the device for dispensing bulk material, and providing a lid and container assembly as described above. The method continues with the steps of pulling the second annular tear strip to fully separate the small disk portion from the skim plate to provide the aperture in an opened configuration, pulling the first annular tear strip to separate the flange from the skim plate such that the skim plate rests on top of the bulk material in the container, and inserting an end of the barrel of the device for dispensing the bulk material through the aperture and into bulk material, and utilizing the device to withdraw a portion of the bulk material to fill the barrel, wherein, as the bulk material is withdrawn from the container, the skim plate continues to rest on the top of the bulk material remaining in the container.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
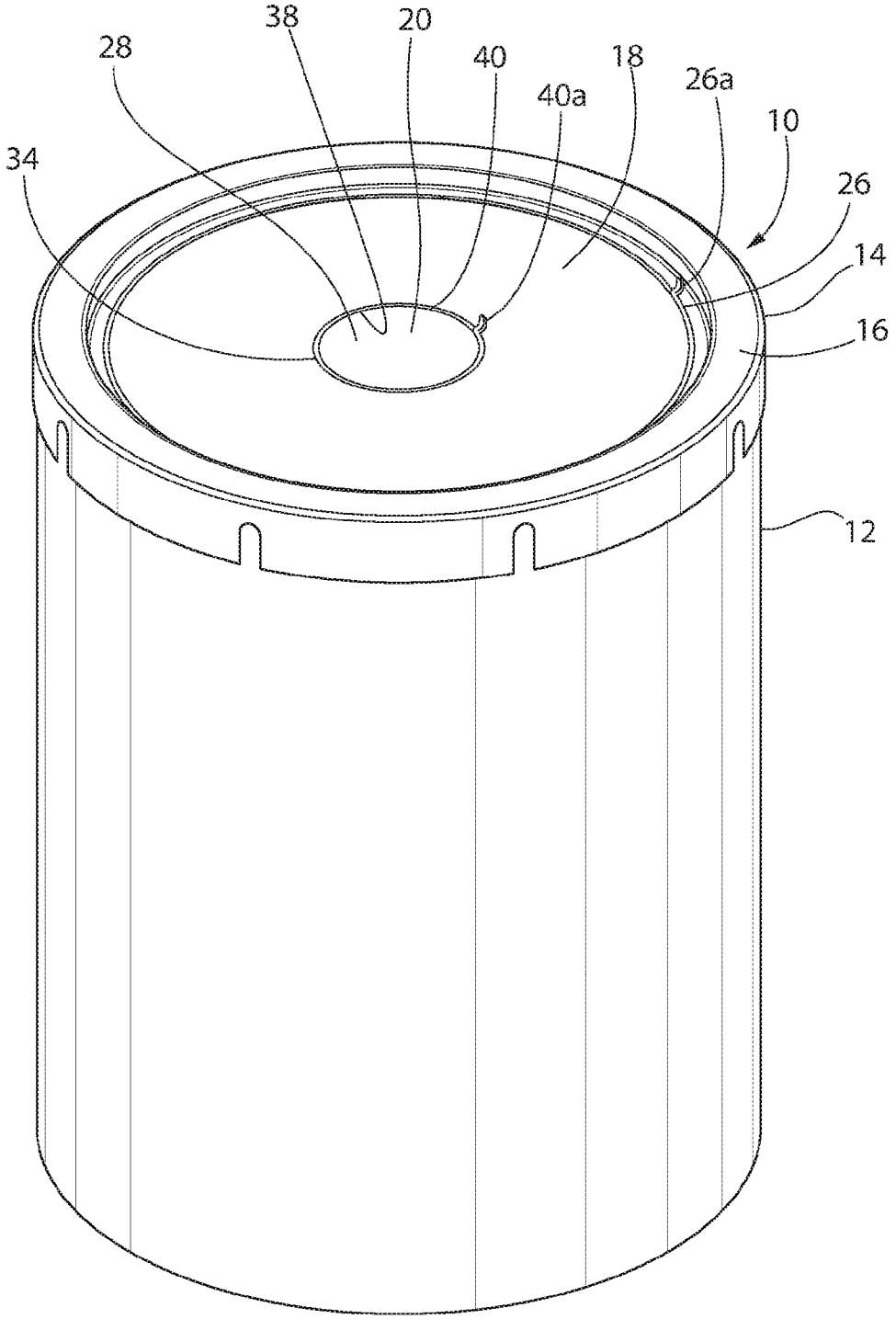
FIG. 1 is an isometric view of a lid and container for bulk material having a breakaway skim plate, in accordance with an exemplary embodiment of the present invention.
Figure 2:
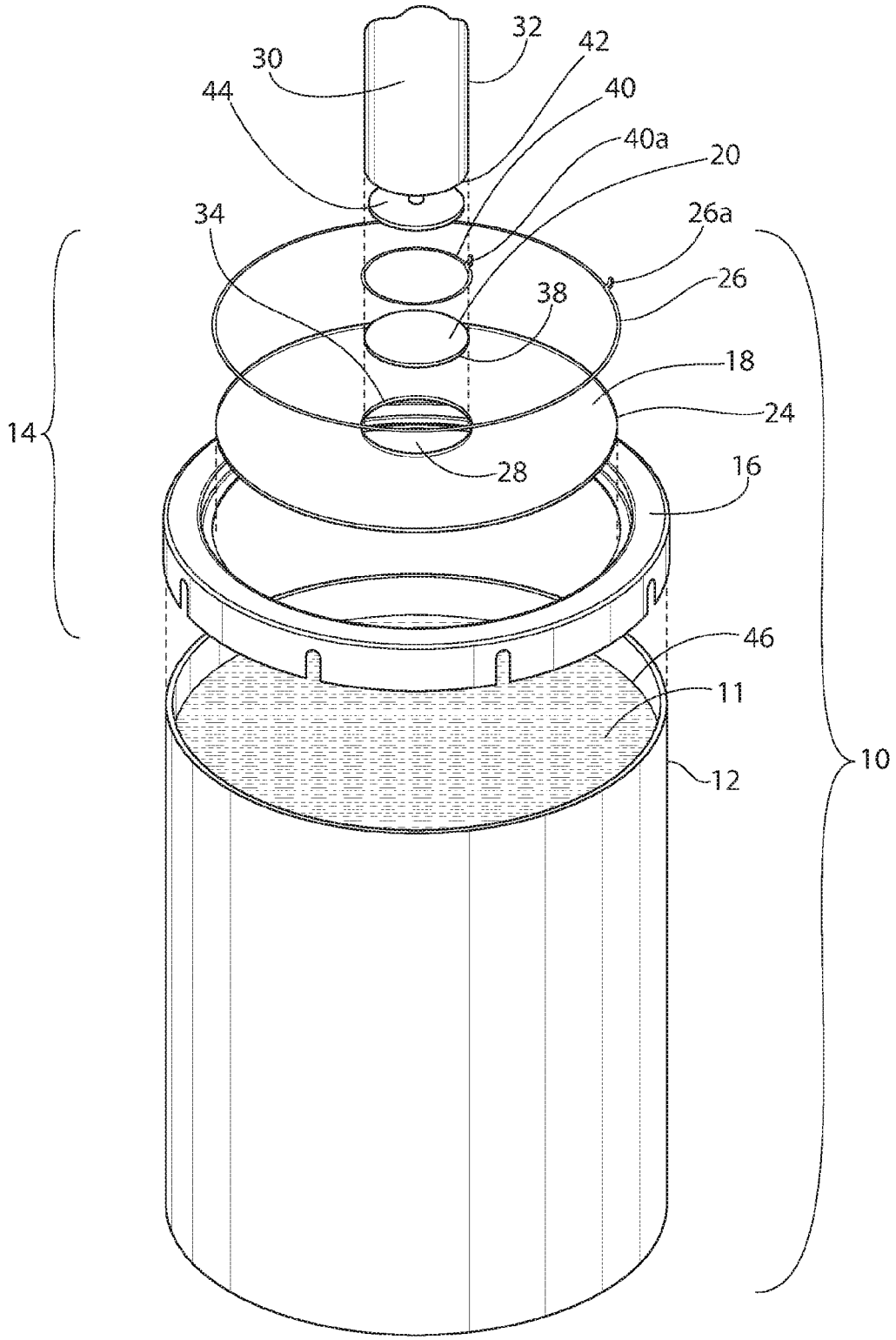
FIG. 2 is an exploded, isometric view of the lid and container of FIG. 1, depicting a barrel and piston of a device for dispensing the bulk material.
Figure 3:
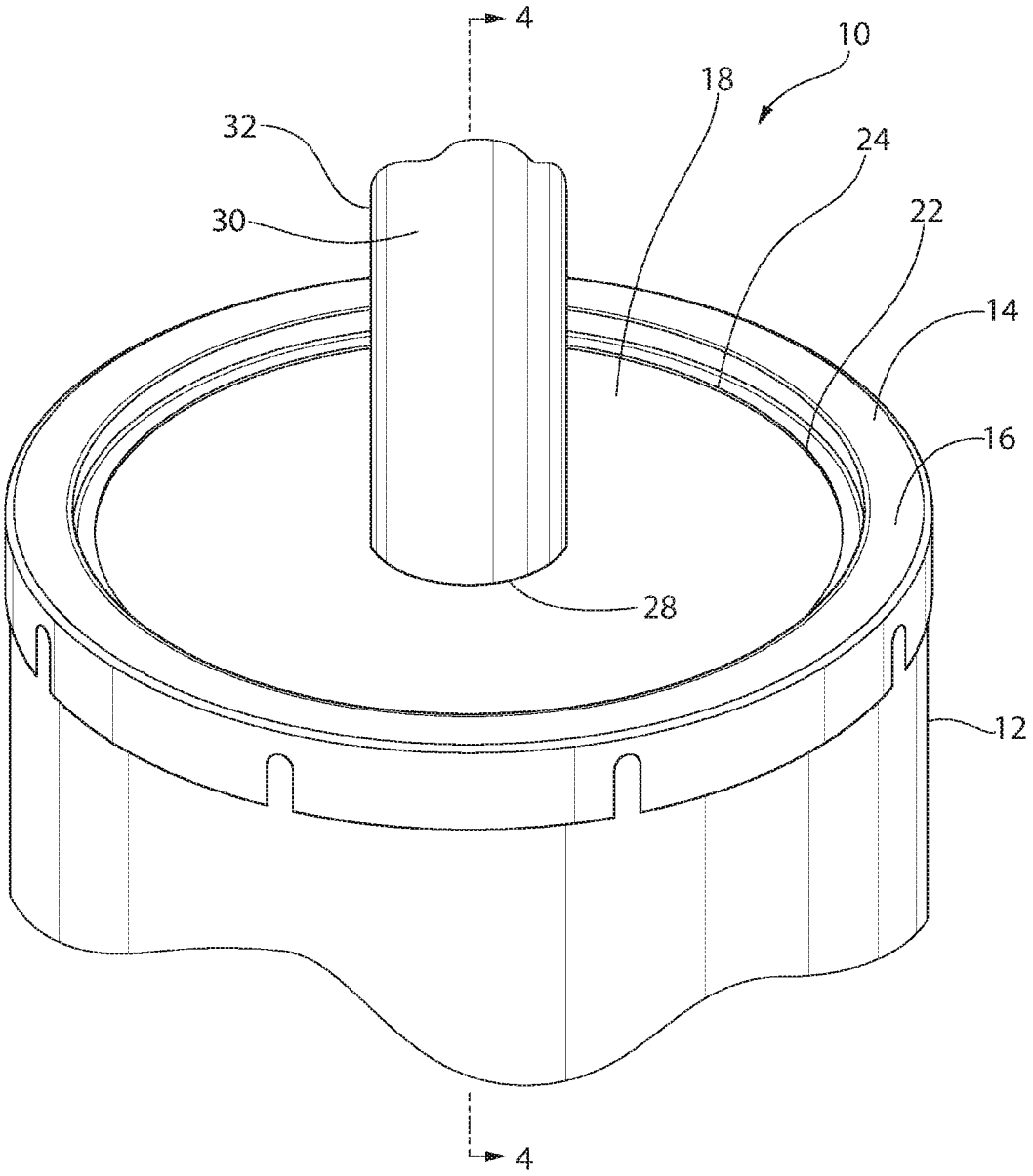
FIG. 3 is an isometric view of the lid and container of FIG. 1; depicting the barrel of FIG. 2 in a position for loading bulk material.

Referring now to the drawing figures, wherein like part numbers refer to like elements throughout the several views, there is shown in FIGS. 1-3 a lid and container assembly 10 in accordance with an exemplary embodiment of the present invention. The lid and container assembly preferably holds bulk viscous material 11, for example, adhesives, caulking compounds and other sealants. However, the present application is also applicable to substantially free flowing materials.

The lid and container assembly 10 includes a container 12 such as the ubiquitous five gallon plastic container commonly known in many industries. The lid and container assembly 10 also includes a unique lid 14 having unique elements as described below.

The lid 14 is preferably molded as a single, integral piece from a plastic material (such as high density polyethylene (HDPE), polyethylene terephthalate (PETE), low density polyethylene (LDPE), polypropylene, etc.) and includes three primary components: an annular flange 16, a skim plate 18 and a small disk portion 20, as will be described below.

The annular flange 16 of the lid 14 provides for sealing of the lid 14 to the container 12. This flange may 16 of any design type examples of which are very well known and very commonly seen in the art. The flange 16 has an internal peripheral edge 22 that is disposed adjacent to an outer peripheral edge 24 of the skim plate 18, separated by a first annular tear strip 26. The first annular tear strip 26 includes a gripping portion 26*a* to provide a place for a user to grab and apply pulling force to the first annular tear strip 26. Prior to a user pulling on the gripping portion 26*a* of the first annular tear strip 26, the combination of the flange 16, the skim plate 18 and the first annular tear strip 26 provide for contiguous plastic such that no bulk material 11 can escape between the flange 16 and the skim plate 18, while the first annular tear strip 26 remains intact, thereby maintaining the integrity of the sealing function of the lid 14.

The skim plate 18 also includes an aperture 28 sized to receive a barrel 30 of a device for dispensing bulk material 32. The aperture 28 has an annular edge 34, and is preferably round in configuration and preferably sized to reasonably closely match the diameter of a typical barrel 30 with minimal clearance. Aperture configurations other than round are also intended to be within the scope of the present invention, particularly for barrels that have a cross section that are other than round.

A small disk portion 20 of the lid is provided which has an outer peripheral edge 38. The small disk portion 20 is disposed in the aperture 28 of the skim plate 18 and is attached by a second annular tear strip 40 disposed between the outer peripheral edge 38 of the small disk portion 20 and the annular edge 34 of the aperture 28 of the skim plate 18. The second annular tear strip 40 includes a gripping portion 40*a* to provide a place for a user to grab and apply pulling force to the second annular tear strip 40. Again, similar to the first annular tear strip 26, prior to a user pulling on the second annular tear strip 40, the combination of the skim plate 18, the second annular tear strip 40, and the small disk portion 20 provide for contiguous plastic such that no bulk material 11 can escape between the skim plate 18 and the small disk portion 20, while the second annular tear strip 40 remains intact, thereby maintaining the integrity of the sealing function of the lid 14.

Again, prior to a user pulling on either the first annular tear strip 26 or the second annular tear strip 40, the lid 14 (including the flange 16, skim plate 18, small disk portion 20, the first annular tear strip 26 and the second annular tear strip 40) is a unitary molded article that functions as a lid capable of completely sealing the container 12.

Once the first annular tear strip 26 is pulled to release the skim plate 18 from the flange 16, the skim plate rests on top of the bulk material 11 remaining in the container 12 to minimize curing or drying of the bulk material 11.

In the configuration shown in the various drawings herein, the small disk portion 20 is centrally located on the lid 14 and coaxial with the central axes of the flange 16 and skim plate 18. While this is an exemplary embodiment, the small disk portion 20 may be located anywhere on the on the surface of the skim plate 18.

Figure 4:
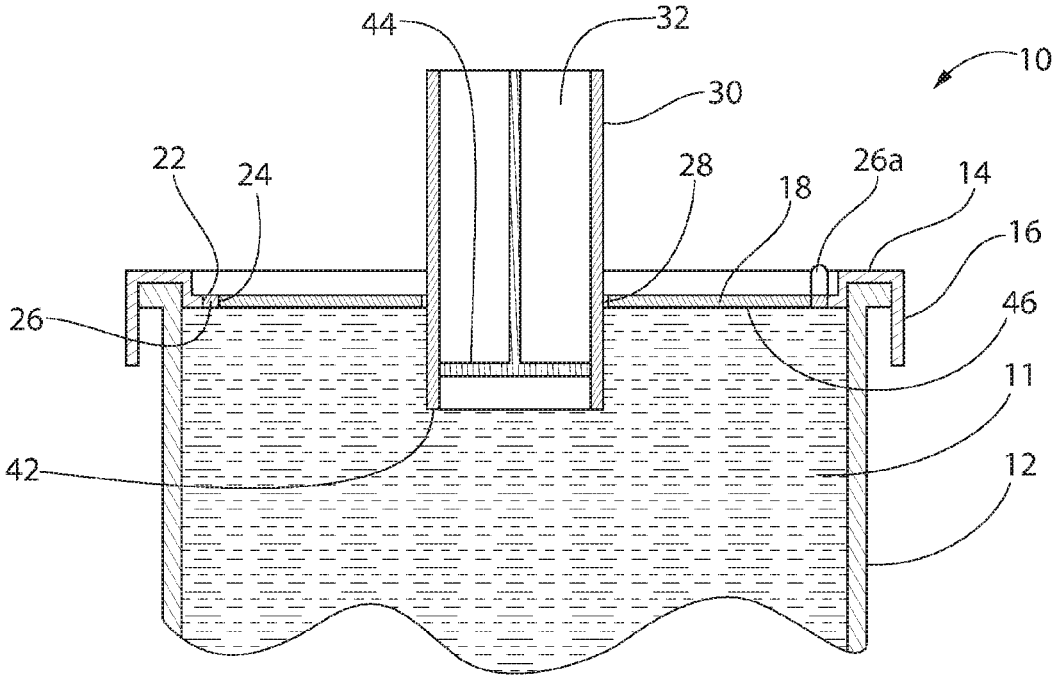
FIG. 4 is a cross sectional view of the lid and container of FIG. 1, taken along lines 4-4 of FIG. 3, depicting the barrel and piston of FIG. 2, shown prior to loading of the barrel with bulk material from the container.
Figure 5:
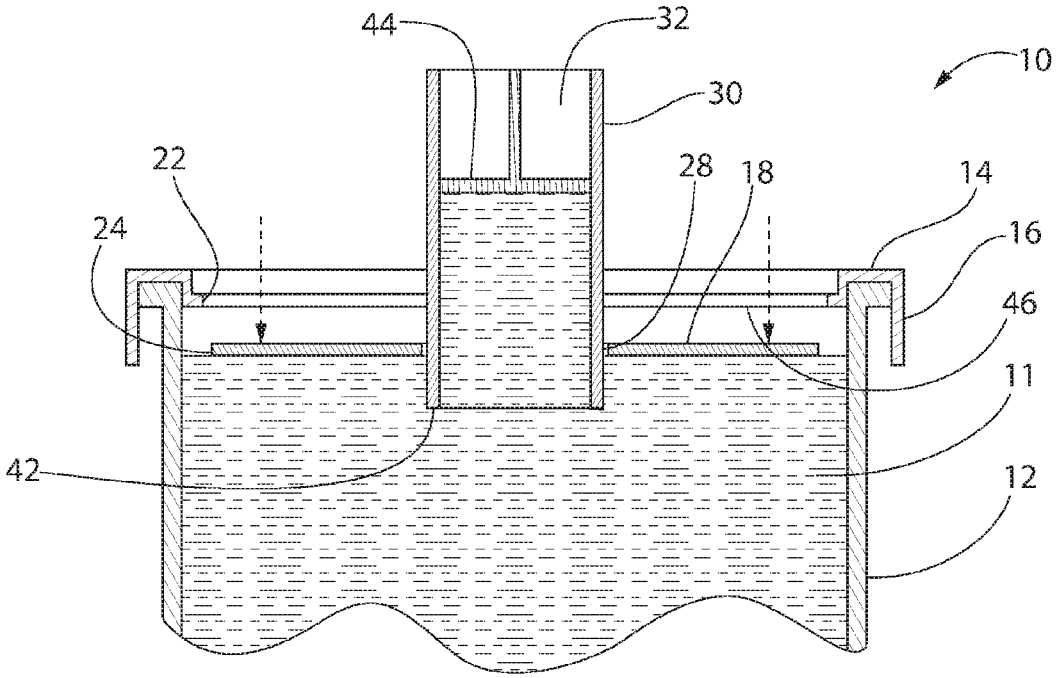
FIG. 5 is an alternate cross sectional view of the lid and container of FIG. 5, taken along lines 4-4 of FIG. 3, shown during loading of the barrel with bulk material from the container.

As shown in FIGS. 4 and 5, in use, loading of bulk material 11 from the container 12 into the barrel 30 of the device for dispensing bulk material 11 is accomplished as follows. A lid and container assembly 10 is provided as described above where the container 12 is filled with bulk material and sealed with the lid 14. The second annular tear strip 40 is pulled to fully separate the small disk portion 20 from the skim plate 18. The small disk portion 20 is removed. An open aperture 28 is thereby provided in the skim plate 18 of the lid 14. Next, the first annular tear strip 26 is pulled to separate the flange 16 from the skim plate 18 such that the skim plate 18 is free of the flange 16 and rests on top of the bulk material 11 in the container 12. An end 42 of the barrel 30 of the device for dispensing the bulk material 32 is inserted through the open aperture 28 and into the bulk material 11. Utilizing the device for dispensing the bulk material 32, a portion of the bulk material 11 is withdrawn from the container 12 (using, for example, a piston 44 of the device for dispensing the bulk material 32) to fill the barrel 30. As the bulk material 11 is withdrawn from the container 12, the level of the top surface 46 of the bulk material 11 goes down (in the direction of the arrows of FIG. 5) in the container 12. The skim plate 18 is free to rest on the top of the bulk material 11 remaining in the container 12. Bulk material 11 in the container and lid assembly may be withdrawn multiple times through the aperture 28 until substantially no bulk material 11 remains in the container 12. Curing or drying of the bulk material is thereby minimized because the skim plate 18 blocks the flow of ambient air to much of the surface of the bulk material 11 remaining in the container 12. When not filling a device for dispensing the bulk material 32, the previously removed small disk portion 20 may be placed in the aperture 28 to further block ambient air from reaching the surface 46 of the bulk material 11. As shown in FIG. 4, the barrel may be filled an initial time prior to removal of the first annular tear strip 26.

It is understood that the invention with its constituent parts described herein is an exemplary indication of a preferred embodiment of the invention, and is given by way of illustration only. In other words, the concept of the present invention may be readily applied to a variety of preferred embodiments, including those disclosed herein. While the invention has been described in detail and with reference to specific examples thereof, it will be apparent to one skilled in the art that various changes and modifications can be made therein without departing from the spirit and scope thereof.

What is claimed is:

1. A lid for use with a container for bulk material, the lid comprising:

(a) an annular flange for sealing the lid to the container, the flange having an internal peripheral edge;

(b) a skim plate having an outer peripheral edge and an aperture sized to receive a barrel of a device for dispensing bulk material, the aperture having an annular edge;

(c) a first annular tear strip disposed between the outer peripheral edge of the skim plate and the internal peripheral edge of the annular flange to release the skim plate from the annular flange;

(d) a small disk portion having an outer peripheral edge, the small disk portion disposed in the aperture of the skim plate;

(e) a second annular tear strip disposed between the outer peripheral edge of the small disk portion and the annular edge of the aperture of the skim plate to release the small disk portion from the skim plate; and (f) the flange, skim plate, small disk portion, the first annular tear strip and the second annular tear strip, all comprising a unitary molded article;

whereby, subsequent to removal of the first and second annular tear strips, withdrawing of the bulk material from the container into the barrel of the device for dispensing bulk material is facilitated through the aperture such that the skim plate rests on top of bulk material remaining in the container to minimize curing or drying of the bulk material.

2. The lid of claim 1, wherein the small disk portion is coaxial with said skim plate.

3. A lid and container assembly for bulk material for loading the bulk material from the container into the barrel of a device for dispensing bulk material, the lid and container assembly, comprising:

(a) the lid, comprising:

(i) an annular flange for sealing the lid to the container, the flange having an internal peripheral edge;

(ii) a skim plate having an outer peripheral edge and an aperture sized to receive a barrel of a device for dispensing bulk material, the aperture having an annular edge;

(iii) a first annular tear strip disposed between the outer peripheral edge of the skim plate and the internal peripheral edge of the annular flange to release the skim plate from the annular flange;

(iv) a small disk portion having an outer peripheral edge, the small disk portion disposed in the aperture of the skim plate;

(v) a second annular tear strip disposed between the outer peripheral edge of the small disk portion and the annular edge of the aperture of the skim plate to release the small disk portion from the skim plate; and (vi) the flange, skim plate, small disk portion, the first annular tear strip and the second annular tear strip, all comprising a unitary molded article;

(b) the container sealingly attached to the lid;

whereby, subsequent to removal of the first and second annular tear strips, withdrawing of the bulk material from the container into the barrel of the device for dispensing bulk material is facilitated through the aperture such that the skim plate rests on top of bulk material remaining in the container to minimize curing or drying of the bulk material.

4. The lid and container assembly of claim 3, wherein the small disk portion is coaxial with said skim plate.

5. A method for loading bulk material from a container into a device for dispensing the bulk material, the method comprising:

(a) providing the device for dispensing bulk material, the device having a barrel for receiving the bulk material;

(b) providing a lid and container assembly, the container filled with the bulk material, the lid sealed to the container, the lid, comprising:

(i) an annular flange for sealing the lid to the container, the flange having an internal peripheral edge;

(ii) a skim plate having an outer peripheral edge and an aperture sized to receive the barrel of a device for dispensing bulk material, the aperture having an annular edge;

(iii) a first annular tear strip disposed between the outer peripheral edge of the skim plate and the internal peripheral edge of the annular flange to release the skim plate from the annular flange;

(iv) a small disk portion having an outer peripheral edge, the small disk portion disposed in the aperture of the skim plate;

(v) a second annular tear strip disposed between the outer peripheral edge of the small disk portion and the annular edge of the aperture of the skim plate to release the small disk portion from the skim plate; and (vi) the flange, skim plate, small disk portion, the first annular tear strip and the second annular tear strip, all comprising a unitary molded article;

(c) pulling the second annular tear strip to fully separate the small disk portion from the skim plate to provide the aperture in an opened configuration;

(d) pulling the first annular tear strip to separate the flange from the skim plate such that the skim plate rests on top of the bulk material in the container; and (e) inserting an end of the barrel of the device for dispensing the bulk material through the aperture and into bulk material, and utilizing the device to withdraw a portion of the bulk material to fill the barrel, wherein, as the bulk material is withdrawn from the container, the skim plate continues to rests on the top of the bulk material remaining in the container.

* * * * *